United States Patent [19]

Hegge et al.

[11] 4,455,692

[45] Jun. 26, 1984

[54] CHEMICAL DISPENSER SAFETY HANGER

[75] Inventors: Robert A. Hegge, Ft. Mitchell, Ky.; David A. Jones, Kettering, Ohio

[73] Assignee: The Drackett Company, Cincinnati, Ohio

[21] Appl. No.: 493,094

[22] Filed: May 9, 1983

[51] Int. Cl.[3] ..... E03D 9/02; A47B 96/06

[52] U.S. Cl. ..... 4/228; 248/214; 248/221.3; 248/297.3

[58] Field of Search ..... 4/225–228, 4/231; 248/215, 221.3, 221.4, 226.5, 297.3, 304, 308, 309 R, 311.3

[56] References Cited

U.S. PATENT DOCUMENTS

| | | | |
|---|---|---|---|
| D. 265,501 | 7/1982 | Cotes | 4/228 X |
| 491,093 | 2/1893 | Edgerton | 248/205 |
| 3,224,056 | 12/1965 | Joffe | 24/16 |
| 3,471,109 | 10/1969 | Meyer | 248/68 |
| 3,979,094 | 9/1976 | De Witt | 248/60 |
| 3,983,603 | 10/1976 | Joyce | 24/16 PB |
| 4,124,207 | 11/1978 | Breslow et al. | 273/1 R |
| 4,168,551 | 9/1979 | Hautmann et al. | 4/231 |
| 4,247,070 | 1/1981 | Dirksing | 248/226.5 |

FOREIGN PATENT DOCUMENTS

| | | | |
|---|---|---|---|
| 2947546 | 6/1981 | Fed. Rep. of Germany | 4/231 |

*Primary Examiner*—Charles E. Phillips
*Attorney, Agent, or Firm*—Charles J. Zeller

[57] ABSTRACT

A hanger to adjustably suspend a chemical dispenser from the rim of a tank comprising a hanger member and a retaining sleeve therefore integral to the dispenser, the hanger member being positionable at discrete levels, which hanger member is substantially non-removable from the sleeve once inserted. A pair of shoulders in the hanger member cooperate with shoulders in the sleeve to prevent removal of the hanger member. Should the hanger member be removed, misuse is prevented by providing the hanger member with a resilient bottom portion that is substantially incapable of puncturing or prying open the chambers containing the chemicals to be dispensed. In a preferred embodiment, a second anti-removal means is provided in the hanger comprising a pyramidal indent in the sleeve and a ramp type stop member in the hanger member.

19 Claims, 5 Drawing Figures

CHEMICAL DISPENSER SAFETY HANGER

FIELD OF THE INVENTION

The present invention relates to a hanger to adjustably suspend a chemical dispenser from the rim of a tank. More specifically, the present invention relates to a hanger comprising a hanger member and a retaining sleeve therefor, for use in conjunction with a toilet tank dispenser, the hanger member being positionable in the sleeve at discrete levels, which hanger member is substantially non-removable from the sleeve once inserted therein. Moreover, the hanger member of the present invention has a resilient bottom portion to prevent misuse as a tool or device to puncture or pry open the chemical containing chambers of the dispenser.

BACKGROUND OF INVENTION

Dispensers adapted to dispense a concentrated chemical solution into a tank when the level of liquid within the tank falls are well known, especially such dispensers used in connection with a toilet tank. For example, U.S. Pat. No. 1,175,032 to Williams discloses an in-tank dispenser wherein the concentrated solution is siphoned from the dispenser upon a lowering by flushing of the tank water. More recently, U.S. Pat. Nos. 4,208,747 to Dirksing and 4,375,109 to Jones disclose in-tank dispensers of the type that are to be suspended from the rim of the tank.

Hangers to suspend such dispensers are known. See, for example, U.S. Pat. No. 4,247,070 to Dirksing disclosing a tilt compensating hanger, wherein the central body portion of the hanger is biased away from the tank wall by an inwardly flexible tab. However, the Dirksing '070 patent does not address the problem wherein a child removes the hanger and uses it as a tool or device to puncture or pry open the chamber containing the chemicals to be dispensed.

SUMMARY OF INVENTION

It is an object of the present invention to provide a hanger adapted to suspend a chemical dispenser from the rim of a tank, which hanger is substantially non-removable from the dispenser.

It is a further object to provide a hanger which adjustably positions the dispenser in the tank.

Another object of the invention is to provide a hanger that, if somehow removed, is substantially incapable of puncturing the dispenser chamber.

The hanger of the present invention is adapted to suspend a chemical dispenser from the rim of a tank, and comprises a sleeve integral with the dispenser and a hanger member insertable within the sleeve. The sleeve has a restricted area proximate its top portion formed by opposed indented side wall segments that define a pair of shoulders with respect to the lower walls of the sleeve, and the hanger member comprises an elongate central portion having a plurality of side wall protrusions, a top portion extending rearwardly from the central portion and adapted to engage the rim of the tank, and a bottom portion whose body is substantially hollow such that the walls of said bottom portion are substantially resilient. A pair of shoulders are formed at the intersection of the bottom portion and the central portion of the hanger member, abutment of said shoulders against the sleeve shoulders preventing removal of the hanger member from the sleeve. The bottom portion may be a fork-like member having a large central slot between opposed side walls, or preferably is a spade-like member having a large central aperture. The hanger member is positionable within the elongate sleeve at various heights by engagement of opposed protrusions between said indented side wall segments.

The top portion of the hanger comprises preferably a planar member substantially normal to the central portion, and one or more resilient, substantially V-shaped members extending downwardly from the edge of said planar member distal the central portion. Preferably, the front wall of the sleeve above the sleeve shoulders is provided with a pyramidal indent, and the central body portion of the hanger is in the form of a U-channel, said U-channel having an interior ramp between the side walls thereof, whereby removal of the hanger from the sleeve is further prevented by abutment of the ramp against the pyramidal indent.

DESCRIPTION OF PREFERRED EMBODIMENT

Figure 1:
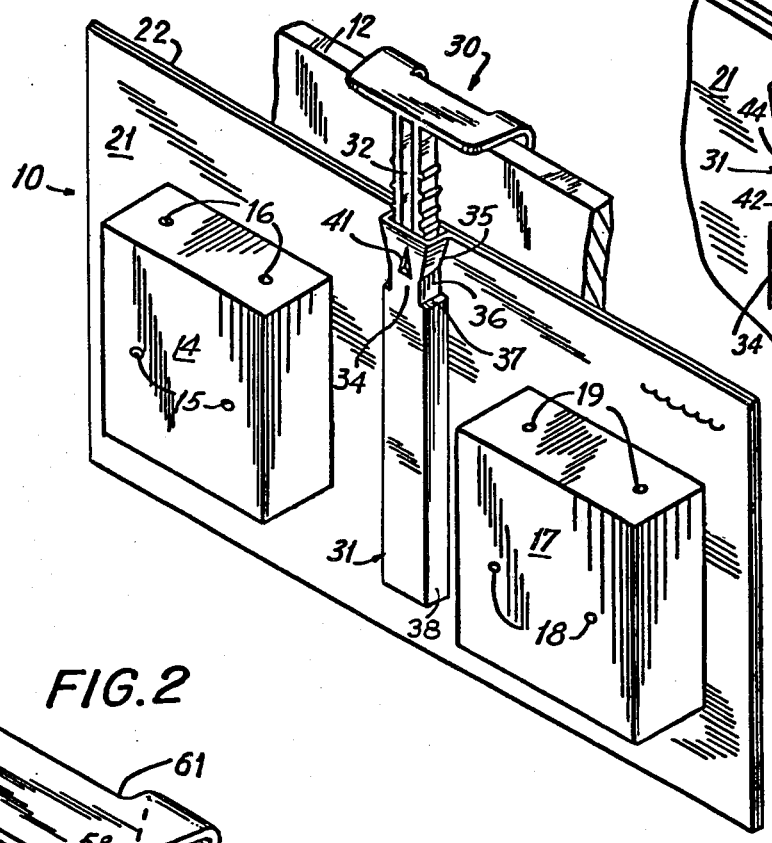
FIG. 1 is a perspective view of a dispenser incorporating the preferred embodiment of the hanger of the present invention, the dispenser being shown suspended from the rim of a tank.

FIG. 1 is a perspective view of a dispenser 10, e.g., a toilet tank dispenser, of the type suspended from rim 12 of a tank (not shown in its entirety). The dispenser 10 comprises, for example, a first dispensing chamber 14 provided with inlet/outlet ports 15 and air vent ports 16; a second dispensing chamber 17, provided with inlet/outlet ports 18 and air vent ports 19, and hanging means, the hanging means shown in FIG. 1 being the preferred embodiment of the hanger 30 of the present invention, which comprises an elongate sleeve 31 and a hanger member 32. The dispenser 10 may be fabricated from two plastic substrate members 21 and 22. Substrate 21 is shaped to provide the dispensing chambers 14, 17 and the sleeve 31, and is hence analogous to a "blister pak" container, while substrate 22 is a planar backing for the dispenser 10, and is sealed to the substrate 21 by heat, suitable adhesive, or radio frequency waves, these sealing methods being conventional, after the chambers 14, 17 have been filled with the materials to be dispensed.

Typically, the materials to be co-dispensed from a dual chamber toilet bowl dispenser of the type shown comprise in one chamber a surfactant composition, and in the other chamber a disinfectant composition, these compositions being in cake, tablet, gel or other form. As the tank liquid rises and enters into the chambers containing these compositions through ports 15, 18, a portion of each composition dissolves forming a concentrated solution, which solution is dispensed upon a lowering of the liquid level.

Although the dispenser shown in FIG. 1 is a dual dispensing unit, i.e., capable of dispensing two specific compositions, a single chamber unit may also incorporate the hanger of the present invention. In addition, the inlet/outlet ports and/or the air vent ports may be replaced with suitable conduit arrangements, with placement of the dispenser in the tank as may be required by the particular design. A dispenser hanger should be suitable for the various dispenser embodiments, and should adjustably position the dispenser within the tank at varying depths, in view of the liquid level variations from tank to tank occasioned by different manufacturers, styles, and piping systems.

A particular problem of chemical dispensers intended for consumer use is the possibility that the hanger member provided with the dispenser would be removed from the sleeve by a child, and used to puncture or otherwise pry open the chambers, thereby exposing the materials within the chambers. The hanger member 32 in combination with the sleeve 31 into which it is inserted is adapted to prevent removal, as well as to fulfull the other functional requirements stated above. The hanger member 32 is further adapted to prevent misuse should it somehow be removed from the sleeve 31.

Referring to FIG. 1, the sleeve 31 is elongate in configuration, and, as mentioned above, is formed by the substrates 21, 22. It extends essentially from the top edge of the dispenser, and is of sufficient length to accommodate the hanger member 32. The sleeve 31 has a restricted area 34 in the shape of a funnel having side wall segments 35 sloped inwardly relative the longitudinal center axis of the sleeve and indented side wall segments 36 extending downwardly from the bottom of sloped wall segments 35. Shoulders 37 are formed between the indented side wall segments 36 and the lower side walls 38 of the sleeve.

Figure 5:
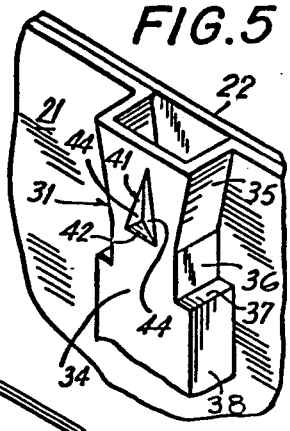
FIG. 5 is an enlarged detail of the restricted area of the sleeve.

Within the restricted area portion 34, there is provided a pyramidal indent 41, shown in detail in FIG. 5, the indent 41 having a triangular base 42 extending into the sleeve 31 and triangular side walls 44.

Figure 2:
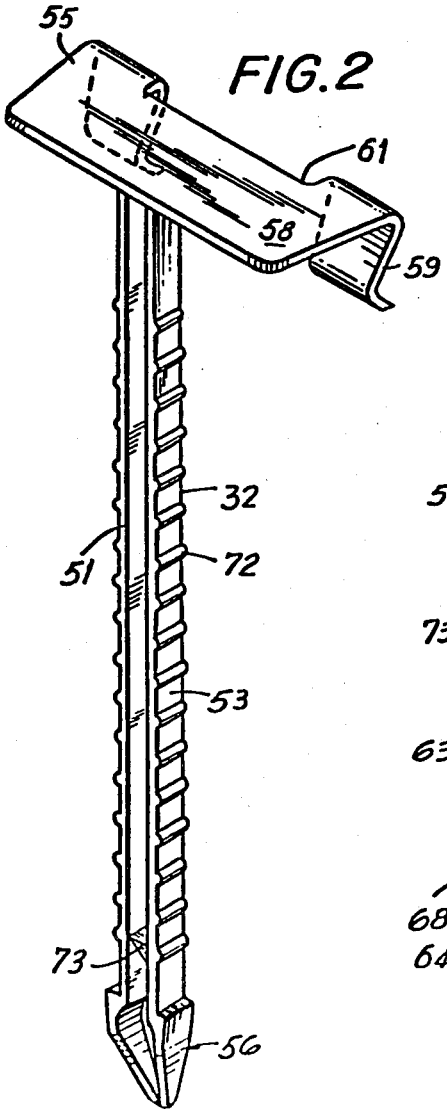
FIG. 2 is a perspective view of the preferred embodiment of the hanger member of the present invention.
Figure 3:
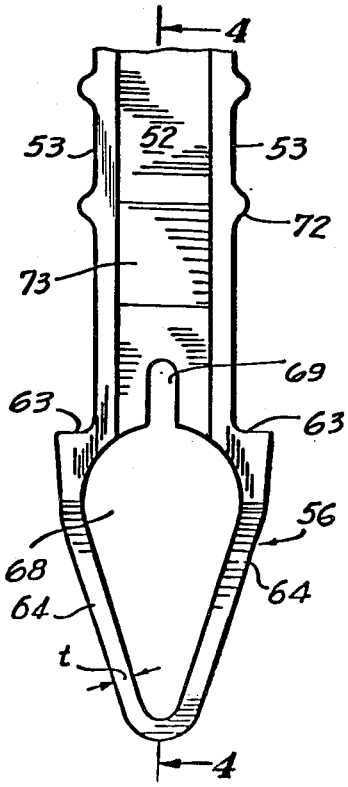
FIG. 3 is an enlarged front view of the bottom portion of the hanger member shown in FIG. 2.
Figure 4:
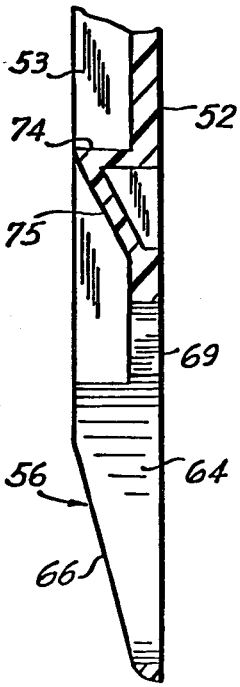
FIG. 4 is a cross-sectional view across section 4—4 of the bottom portion of the hanger member shown in FIG. 3.

Referring to FIG. 2, the hanger member 32 comprises a central body portion 51 in the form of an elongate U-channel having a rear wall 52 and side walls 53, a top portion 55 extending rearwardly from the U-channel 51, and a bottom portion whose body is substantially hollow such that the walls of the bottom portion are resilient, the body of the bottom portion shown in FIG. 2 being the spade shaped member 56. The top portion 55 comprises a planar member 58 essentially normal to the U-channel 51 and two resilient, substantially V-shaped members 59 extending downwardly from edge 61 distal the U-shaped channel 51 in spaced-apart relationship. Preferably, the planar member 58 is pitched from about 1 to about 10 degrees with respect to the U-channel 51. The spade-like member 56, as best seen in FIGS. 3 and 4, forms exterior shoulders 63 at its intersection with the U-shaped channel 51, and extends downwardly, the sides 64 converging towards the longitudinal center axis of the channel 51. Further, the front surface 66 of the spade-like member 56 is seen to slope inwardly toward the rear of the hanger member 32, the back surface of the spade-like member 56 being coplanar with rear wall 52 of the channel 51. The body of the spade-like member 56 is provided with an ovate aperture 68 such that the wall thickness is substantially uniform below the top semiaxis of the aperture, assuring that lower portion 66 is substantially resilient. Preferably, thickness is between 15 and 50 mils. A compression relief slot 69 is provided at the top of the aperture 68, which slot 69 extends upwardly into the rear wall 52 of the channel 51. The slot permits the spade-like member 56 to flex inwardly about the longitudinal center axis of the hanger member 32 when the hanger member is first inserted into the sleeve. In lieu of the spade-like member the bottom portion can be a fork-like member having a pair of flexible opposed side walls, there being a large slot therebetween.

The U-channel 51 is provided on each side 53 with a plurality of horizontal semicylindrical projections 72 which engage the indented wall segments 36 of the sleeve 31, thereby permitting placement of the hanger member 32 at a plurality of positions within the sleeve 31. Further provided in the U-channel 51 is a ramp member 73 positioned within the U proximate the bottom portion 56 and above the slot 69, the base 74 of the ramp 73 engaging the pyramidal indent 41 at full extension of the hanger member 32, thereby ensuring retention of the hanger member 32 in sleeve 31. The sloped side walls 44 of the indent 41, and the sloped side wall 75 of the ramp 73, however, permit easy first insertion of the hanger 32 into the sleeve. Insertion of the hanger is further facilitated by the compression relief slot 69, as noted above.

In view of the ovate aperture 68, which substantially occupies the entire body of the spade-like member 56, and the sloped surface 66, the spade-like member 56 is considerably resilient, and flexes easily when a force is applied thereto. Hence, it is essentially incapable of being misused as a tool or device to puncture or pry open the dispenser. The hanger member 32 may be made from a great variety of plastics, and is preferably manufactured by molding techniques, which are conventional. The U-channel construction of the elongate central portion provides strength to the hanger member 32, while at the same time permitting the central portion 51 to bow slightly. It is to be understood that the specific preferred embodiments of the invention, described and illustrated in detail herein, are not to be construed as limiting the scope of the invention being defined by the claims appended hereto.

We claim:

1. A hanger adapted to suspend a chemical dispenser from the rim of a tank, the hanger comprising an elongate sleeve integral with the dispenser, the sleeve having a restricted area proximate its top formed by opposed indented side wall segments that define a pair of shoulders with respect to the lower side walls of the sleeve, and a hanger member insertable within said sleeve, the hanger member comprising an elongate central portion having a plurality of side wall protrusions, a top portion extending rearwardly from the central portion and adapted to engage the rim of the tank, and a bottom portion forming opposed exterior shoulders with respect to the elongate central portion, the body of said bottom portion being substantially hollow such that the walls of the bottom portion are resilient below the shoulders, whereby the hanger member is inserted into said sleeve by engagement of said resilient bottom portion with said opposed indented side wall segments, which said bottom portion flexes due to its hollow nature and allows said opposed exterior shoulders to pass by said restricted area, said hanger member is adjustably positionable within the elongate sleeve by engagement of the protrusions between said indented wall segments, and whereby removal of the hanger member from the sleeve is substantially prevented by the hanger member shoulders abutting said sleeve shoulders.

2. The hanger of claim 1 wherein the bottom portion is a fork-like member having a large central slot.

3. The hanger of claim 1 wherein the bottom portion is a spade-like member having a large central aperture.

4. The hanger of claim 3 wherein the central aperture is ovate in configuration, the wall thickness of the spade-like member being substantially uniform below the larger semiaxis of the aperture, and wherein the front surface of the spade-like bottom portion slopes rearwardly from top to bottom.

5. The hanger of claim 4 wherein the thickness of the wall of the spade-like member is between from about 15 to about 50 mils.

6. The hanger of claim 1 wherein the central portion is an elongate U-channel.

7. The hanger of claim 6 wherein the restricted area of the sleeve is provided with a pyramidal indent in its front wall, and wherein a ramp is provided within the U-channel proximate the bottom portion, whereby the base of the ramp abuts the pyramidal indent to further prevent removal of the hanger member from the sleeve.

8. The hanger of claim 7 wherein a compression relief slot extends into the U-member from the top of the hollow body of the bottom portion.

9. The hanger of claim 7 wherein the protrusions are horizontal and are semicylindrical in configuration, and wherein the restricted area is funnel-shaped.

10. A dispenser incorporating the hanger of claim 9.

11. The hanger of claim 1 wherein the top portion of the hanger member comprises a planar member substantially normal to the central portion, and one or more resilient, substantially V-shaped members that extend downwardly from the edge of said planar member distal the central portion.

12. The hanger of claim 11 wherein there are two V-shaped members in spaced-apart relationship adapted to engage the rim of the tank.

13. The hanger of claim 12 wherein the planar member is pitched between about 1 to about 10 degrees with respect to the central portion.

14. A dispenser incorporating the hanger of claim 13.

15. A dispenser incorporating the hanger of claim 1.

16. A hanger to suspend a chemical dispenser from the rim of a tank, the hanger comprising an elongate sleeve integral with the dispenser, the sleeve having a restricted area proximate the top in the shape of a funnel, a pyramidal indent being provided in the front wall thereof, with opposed shoulders being formed between the restricted area and the lower side walls of the sleeve, and a hanger member insertable within the elongate sleeve, said hanger member comprising a central portion in the form of a U-channel, the side walls thereof having a plurality of opposed horizontal, semicylindrical protrusions in spaced-apart relationship, the U-channel being further provided proximate its lower end with a ramp between its side walls, the base of said ramp adapted to engage the pyramidal indent; a top portion extending rearwardly from said U-channel, the top portion comprising a planar member substantially normal to the U-channel and a pair of substantially V-shaped members extending downwardly from the edge of the planar member distal the U-channel, said top portion being adapted for engagement of the rim of the tank, and a bottom portion that is a spade-like member, said spade-like member forming exterior shoulders at the sides of the U-channel, and having an ovate aperture therein to define resilient side walls of substantially uniform thickness below the larger semiaxis of the aperture, a compression relief slot extending upwardly from the top of the aperture into the rear wall of the U-channel, whereby the hanger member may be inserted into said sleeve by engagement of said resilient side walls with said opposed shoulders, which said resilient said walls flex and allow said resilient side walls to pass by said opposed shoulders, said hanger member is placed at the desired depth within the sleeve by engaging opposed protrusions between the side walls of the restricted area, and whereby removal of the hanger member is substantially prevented by the hanger member shoulders abutting the sleeve shoulders and the base of the ramp abutting the pyramidal indent.

17. The hanger of claim 16 wherein the planar member of the top portion of the hanger member is pitched between about 1 to about 10 degrees with respect to the U-channel.

18. The hanger of claim 17 wherein the side walls of the spade-like member have a wall thickness of from about 15 to about 50 mils, and wherein the lower section of the spade-like bottom portion slopes rearwardly from top to bottom.

19. A dispenser incorporating the hanger of claim 18.

* * * * *